US006210506B1

(12) United States Patent
Young

(10) Patent No.: US 6,210,506 B1
(45) Date of Patent: Apr. 3, 2001

(54) ABRADING MATERIAL

(75) Inventor: Michael Young, Mansfield (GB)

(73) Assignee: Impak Marketing Limited, Cambridgeshire (GB)

( * ) Notice: Subject to any disclaimer, the term of this patent is extended or adjusted under 35 U.S.C. 154(b) by 0 days.

(21) Appl. No.: 09/077,243

(22) PCT Filed: Nov. 21, 1996

(86) PCT No.: PCT/GB96/02880

§ 371 Date: May 21, 1998

§ 102(e) Date: May 21, 1998

(87) PCT Pub. No.: WO97/19211

PCT Pub. Date: May 29, 1997

(30) Foreign Application Priority Data

Nov. 23, 1995 (GB) ..... 9523972

(51) Int. Cl.[7] ..... D04B 1/04

(52) U.S. Cl. ..... 156/85; 156/148; 15/229.11; 15/244.4; 66/191

(58) Field of Search ..... 156/148, 84, 85; 15/229.11, 244.4; 66/191

(56) References Cited

U.S. PATENT DOCUMENTS

| | | | | |
|---|---|---|---|---|
| 3,673,295 | * | 6/1972 | Winchklhofer | 264/230 |
| 3,831,368 | * | 8/1974 | Glowacki | 57/239 |
| 3,984,328 | * | 10/1976 | Brun | 264/323 |
| 4,628,709 | * | 12/1986 | Aeschbach | 66/91 |
| 4,704,757 | * | 11/1987 | Young | 15/104.94 |
| 5,455,060 | * | 10/1995 | Neamy | 427/227 |
| 5,476,506 | * | 12/1995 | Lunn | 623/9 |

FOREIGN PATENT DOCUMENTS

| | | |
|---|---|---|
| 295 03 874 U | 7/1995 | (DE) . |
| 0 336 507 A1 | 10/1989 | (EP) . |
| 2 157 329 | 10/1985 | (GB) . |
| 1292139 | 11/1989 | (JP) . |

* cited by examiner

*Primary Examiner*—Sam Chuan Yao
(74) *Attorney, Agent, or Firm*—Sheridan Ross P.C.

(57) ABSTRACT

The present invention provides a method of making an abrading sheet material comprising knitting a ground structure comprising a shrinkable polyolefin yarn with laid-in looped threads of a material which is preferably harder than that or those of the ground structure, such that the loop threads are raised from a surface of the ground structure, and shrinking the shrinkable yarn of the ground structure to grip the looped threads to lock the loops in place in the ground structure.

13 Claims, 2 Drawing Sheets

ABRADING MATERIAL

DESCRIPTION

TECHNICAL FIELD

The invention relates to abrading material for use, for example, in the manufacture of scouring pads.

BACKGROUND ART

GB-B-2157329 discloses a method of making an abrading sheet material which comprises knitting a ground structure from a mixture of a polyester yarn of a heat shrinkable PVC yarn with laid-in floated threads of a second material of polyester which is harder than and either non-shrinkable or less shrinkable than the ground structure materials and shrinking the ground structure so that loops of the second material are raised from a surface thereof.

GB-B-2157329 also discloses an abrading sheet material comprising a knitted ground structure including yarns polyester and of a heat shrinkable PVC material having laid in floated threads of a second material of polyester which is harder than and either non-shrinkable or less shrinkable than the ground structure materials, the ground structure being shrunk causing loops of the second material to extend from a surface thereof.

Material made in accordance with GB-B-2157329 provides good abrading properties but possesses certain disadvantages. Thus, for example, heat shrinkable PVC yarns are expensive. Also it is not readily possible to heat weld or bond such known abrading materials since the melt temperatures of the yarns which make up the ground structure of the known abrading material are widely separated. Thus, at present it is necessary to secure such materials to a backing or the like by stitching and/or an adhesive in order to form an abrasive pad.

It is an object of the invention to provide an abrading material which is relatively inexpensive to manufacture.

It is a further object of the invention to provide an abrading material which may readily be heat welded or bonded to other materials, e.g. plastics foam materials.

DISCLOSURE OF INVENTION

From one aspect the present invention provides a method of making an abrading sheet material comprising knitting a ground structure comprising a shrinkable polyolefin yarn with laid-in looped threads of a material which is preferably harder than that or those of the ground structure, such that the loop threads are raised from a surface of the ground structure, and shrinking the shrinkable yarn of the ground structure to grip the looped threads to lock the loops in place in the ground structure.

Preferably the polyolefin yarn is heat shrinkable, and preferably the method of making an abrading material comprises the step of heat treating the ground structure so that the polyolefin yarn in the ground structure contracts to grip the looped threads to lock the loops in place. The heat shrinking properties of the polyolefin yarn are preferably controlled by subjecting the yarn to a pre-treatment process, known per se, which consists of nipping the yarn at intervals along its length under pressure and at a temperature above its heat shrinking temperature.

Preferably the ground structure also comprises a yarn which is substantially non heat shrinkable or which is less heat shrinkable than the polyolefin yarn, e.g. polyester yarn.

Preferably the looped threads are of polyester. The looped threads may be of a yarn or tape made by cutting a synthetic polyester film such as that sold under the Registered Trade Mark "Mylar". It will be appreciated however that other abrasive tapes or yarns may be utilised.

From a preferred aspect the present invention provides a method of making an abrading sheet material which comprises knitting a ground structure from a polyester yarn and from a heat shrinkable polyolefin yarn with laid-in looped threads of a material, which is preferably harder than the ground structure yarns, such that loops are raised from a surface of the ground structure, and heat treating the ground structure while restraining the ground structure against shrinkage so that the polyolefin yarn in the ground structure contracts to lock the loops in place.

During the knitting process the loop forming material will preferably be positively fed through the knitting machine to form the loops, rather than being held under tension during knitting.

From another aspect the invention is a method of making a scouring pad comprising the step of heat bonding or welding abrading sheet material as described above to a backing of a suitable resilient thermoplastic material e.g. a resilient material such as polyethylene or polyether foam.

From yet another aspect, the present invention provides an abrading sheet material comprising a knitted ground structure comprising a shrinkable polyolefin yarn having laid in looped threads of a material which is preferably harder than that or those of the ground structure, such that loops extend from a surface of the ground structure, and in which the ground structure has been treated to shrink the shrinkable yarn to cause it to grip the looped threads to lock the loops in position.

When the abrading sheet of the present invention is used to provide the working surface of a scouring pad, backed by a resilient pad e.g. of a plastics foam, which may be impregnated with a detergent, the said surface of the sheet from which the loops extend forms the external surface of the pad so that in use of the pad substantially only the loops make contact with the work be scoured, the ground structure serving mainly as an anchor for the loops and as a ground for attachment to the backing.

Thus from a further aspect the invention provides an abrading device comprising a sheet of abrading material as described above attached by heat bonding or welding to a backing pad of foamed plastics such as polyethylene, or polyether. A preferred method of welding is impulse heat welding but it is conceivable that ultrasonic welding may be employed.

BRIEF DESCRIPTION OF DRAWINGS

A preferred embodiment of the present invention will now be described with reference to the accompanying diagrammatic drawings, in which.

BEST MODE FOR CARRYING OUT THE INVENTION

Figure 1:
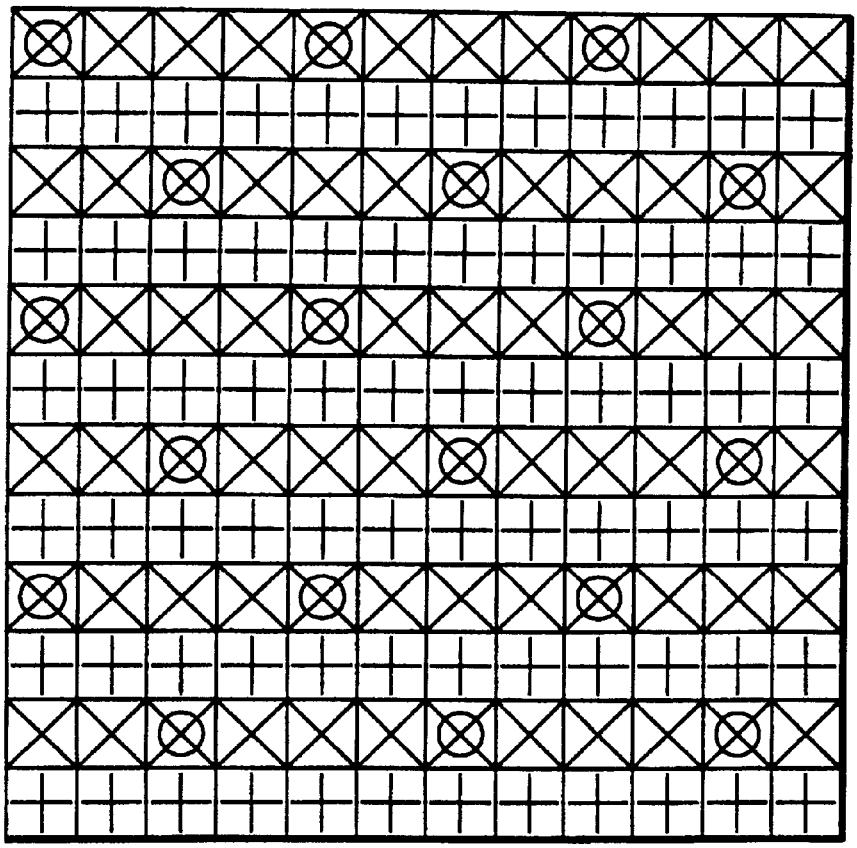
FIG. 1 is a pattern illustrating how abrading material in according with the invention is knitted.

A ground structure of an abrading sheet material is knitted according to the pattern of FIG. 1 in which the "x" lines indicate courses of heat shrinkable polyolefin yarn and the "+" lines indicate course of polyester yarn. During knitting polyester yarn e.g. that sold under the Registered Trade Mark "Mylar" in the form a cut tape is laid in, being tucked to each fourth stitch of polyolefin yarn across the courses, the tucks 0 of alternative threads of polyester tape having a walewise staggered relationship so that the loops of polyester tape are not in alignment in the direction of the wales of the fabric. The polyester tape is positively fed through the knitting machine such that loops are formed above the ground structure.

Figure 2:
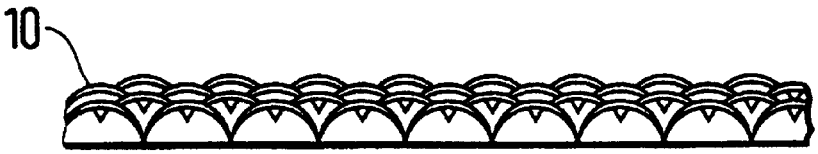
FIG. 2 is a perspective view illustrating the top or working surface of the material.

FIG. 2 diagrammatically illustrates the top surface of the fabric after it has been knitted. It will be seen that the loops 10 of polyester tape stand up from the ground structure 12. The fabric is now subjected to heat treatment while the opposed edges of the ground structure are held to prevent shrinkage so that the polyolefin yarn of the ground structure shrinks or sets to lock the loops in the ground structure.

Figure 3:
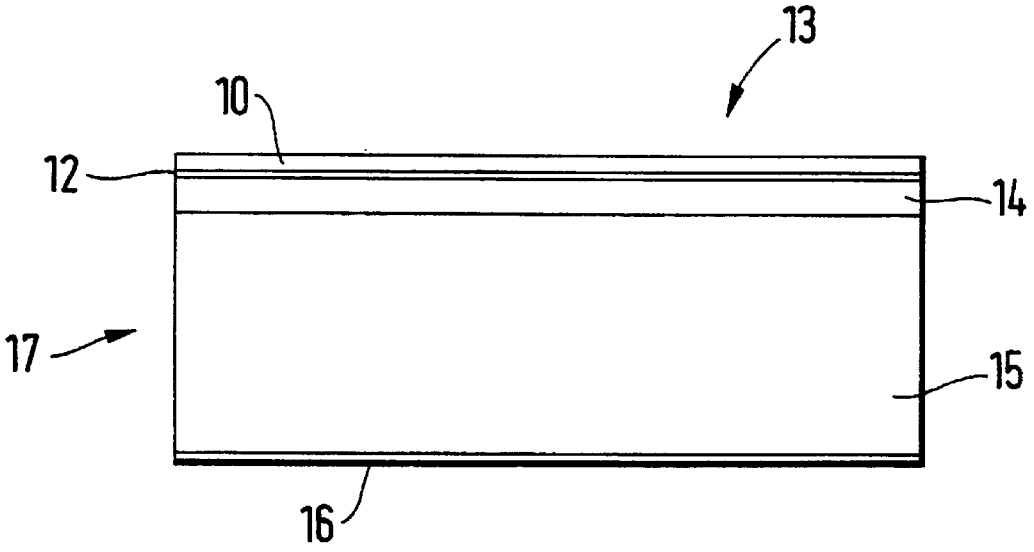
FIG. 3 is a side view of a scouring pad incorporating abrading material of the present invention.

One use of the thus made fabric is as the working surface 13 of a scouring pad 17 as shown in FIG. 3. The underside or non-working side of the ground structure 12 a suitably sized piece of the fabric 10,12 is attached by impulse heat welding to a thin backing pad 14 of foam polyethylene plastics so that the top or working surface 13 of the fabric including the loops 10 is on the outside. A thicker layer 15 of polyether foam is attached to the polyethylene foam layer to form the bulk of the pad. The surface of the pad opposite to the abrading layer 13 is preferably covered by a foamed cellulosic layer 16 to form a wiping surface. If desired the layer of polyethylene foam 14 can be dispensed with, so that the abrading fabric is attached directly to the polyether foam layer by impulse heat welding. In this case the characteristics of the scouring action is less aggressive than would be the case if the polyethylene layer were present.

INDUSTRIAL APPLICABILITY

A scouring pad produced in this way has useful characteristics in that each floated polyester loop presents to the work a hoop with sharp lateral edges which projects from the pad. Such a loop has good scouring action while being less deformable than e.g. a fibre and will have adequate strength without a tendency to inflict damage.

What is claimed is:

1. A method of making an abrading sheet material, the method comprising the steps of:

knitting a ground structure comprising a shrinkable polyolefin yarn, the polyolefin yarn being heat shrinkable;

during knitting, laying in looped threads of a second material which is harder than that of the ground structure, wherein said laid in looped threads are raised from a surface of the ground structure;

heat treating the ground structure so that the polyolefin yarn in the ground structure contracts to grip the looped threads to lock the loops in place; and holding the ground structure to restrict shrinkage during heat treatment.

2. A method according to claim 1, further comprising controlling the heat shrinking properties of the polyolefin yarn by subjecting the yarn to a pre-treatment process, comprising nipping the yarn at intervals along its length under pressure and at a temperature above its heat shrinking temperature.

3. A method according to claim 1, wherein the ground structure further comprises a yarn which is substantially non-heat shrinkable or which is less heat shrinkable than the polyolefin yarn.

4. A method according to claim 3, wherein the substantially non-heat shrinkable or less heat shrinkable yarn is of polyester.

5. A method according to claim 1, wherein the looped threads are made of polyester.

6. A method according to claim 5, wherein the looped threads are of a yarn or tape made by cutting a synthetic polyester film.

7. A method according to claim 1, further comprising positively feeding the loop forming material through a knitting machine during knitting to form the loops.

8. A method according to claim 1, further comprising securing said abrading sheet material to a backing of a suitable resilient thermoplastic material.

9. A method according to claim 8, wherein the backing is made of polyethylene and/or polyether foam.

10. A method according to claim 9, further comprising heat bonding or welding said abrading sheet material to the backing.

11. A method according to claim 8, further comprising securing the backing to the abrading sheet material by impulse heat welding.

12. An abrading device comprising:

a sheet of abrading material made according to claim 1; and a backing pad of foamed plastics attached to said sheet.

13. An abrading device according to claim 12, wherein the attachment is by heat bonding or welding.

* * * * *